US007441373B2

(12) United States Patent
Erskine

(10) Patent No.: US 7,441,373 B2
(45) Date of Patent: Oct. 28, 2008

(54) DOOR ASSEMBLY AND DOOR ADJUSTING MECHANISM

(75) Inventor: Edward J. Erskine, Benson, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 532 days.

(21) Appl. No.: 11/183,815

(22) Filed: Jul. 19, 2005

(65) Prior Publication Data

US 2007/0033879 A1 Feb. 15, 2007

(51) Int. Cl.
*E05D 13/00* (2006.01)

(52) U.S. Cl. ..... 49/409; 49/404; 49/411; 49/425

(58) Field of Classification Search ..... 49/404, 49/409, 410, 411, 425
See application file for complete search history.

(56) References Cited

U.S. PATENT DOCUMENTS

| | | | | | |
|---|---|---|---|---|---|
| 856,607 | A * | 6/1907 | Schuyler et al. | ..... | 16/94 R |
| 1,176,152 | A * | 3/1916 | Lawrence | ..... | 16/105 |
| 3,033,285 | A * | 5/1962 | Banner | ..... | 49/425 |
| 3,237,238 | A * | 3/1966 | Anderson | ..... | 16/105 |
| 3,696,560 | A * | 10/1972 | Hallin | ..... | 49/425 |
| 3,750,337 | A * | 8/1973 | Brydolf et al. | ..... | 49/411 |
| 3,996,643 | A * | 12/1976 | Steigerwald | ..... | 16/99 |
| 4,262,451 | A * | 4/1981 | Dallaire | ..... | 49/425 |
| 4,811,683 | A * | 3/1989 | Gephart et al. | ..... | 16/97 |
| 4,833,829 | A * | 5/1989 | Wilson | ..... | 49/426 |
| 5,161,330 | A * | 11/1992 | Auriemma | ..... | 49/420 |
| 5,224,297 | A | 7/1993 | Watkins | | |
| 5,791,089 | A * | 8/1998 | Prevot et al. | ..... | 49/425 |
| 6,021,547 | A * | 2/2000 | Stagoll | ..... | 16/105 |
| 6,427,286 | B1 | 8/2002 | Erskine | | |
| 6,698,138 | B1 * | 3/2004 | Lin | ..... | 49/409 |
| 2001/0054258 | A1 * | 12/2001 | Becken | ..... | 49/409 |

* cited by examiner

*Primary Examiner*—Katherine W Mitchell
*Assistant Examiner*—Catherine A Kelly
(74) *Attorney, Agent, or Firm*—Nixon & Vanderhye P.C.

(57) ABSTRACT

A door adjusting mechanism enables adjusting a position of a door moving in a track. The adjusting mechanism includes a truck member secured to the door and having moving structure engageable with the track. A connector connects the truck member to the door and includes cam structure for adjusting a position of the door relative to the truck member, thereby adjusting a position of the door relative to the track. In one arrangement, the truck member supports an adjuster bolt, and a connector includes an offset aperture that fits over the adjuster bolt. A nut is engageable with the adjuster bolt to secure the connector to the truck member. A position of the door in the track is adjusted by simply rotating the connector.

15 Claims, 6 Drawing Sheets

DOOR ASSEMBLY AND DOOR ADJUSTING MECHANISM

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a door assembly including a door adjusting mechanism and, more particularly, to a door assembly including a door adjusting mechanism for adjusting a door riding in a track for proper alignment and to accommodate size irregularities and manufacturing tolerances.

In the installation of movable panels, such as windows and doors, particularly companionway doors on boats, such as shown in U.S. Pat. Nos. 6,427,286, 5,224,297 and 4,833,829 (the disclosures of which are hereby incorporated by reference herein), it is highly desirable to be able to adjust the panel with respect to the track during or after track installation. Particularly on boats adjustment is desirable because manufacturing tolerances in the panel and boat deck or other components with which the panel is associated may adversely impact movement (sliding, rolling, etc.) of the door, and either make the movement difficult, or make it so that a good seal (and substantially a water-tight seal) is difficult or impossible to achieve. Also, it is highly desirable to be able to remove the panel after installation, for replacement or servicing, without having to remove the tracks.

BRIEF SUMMARY OF THE INVENTION

In order to permit door alignment adjustment and/or to accommodate size irregularities and manufacturing tolerances without disassembling a door, a door adjusting mechanism includes a connector having an offset aperture that acts as a cam member to adjust a position of the door relative to the track. In use, the connector need only be loosened via a nut or the like, and adjustments can be made by rotating the connector. Due to the offset axis of the connector aperture, rotation of the connector shifts a position of the door relative to the track, thereby adjusting door alignment and/or accommodating size irregularities and manufacturing tolerances.

In an exemplary embodiment of the invention, a door adjusting mechanism enables adjusting a position of a door moving in a track. The door adjusting mechanism includes a truck member secured to the door and including moving structure engageable with the track, where the truck member supports an adjuster bolt. A connector includes an offset aperture that fits over the adjuster bolt, and a nut is engageable with the adjuster bolt to secure the connector to the truck member. With this structure, a position of the door in the track is adjusted by simply rotating the connector. In one arrangement, the connector includes adjustment apertures therein sized to receive a spanner for rotating the connector. The truck member may include a T-slot, where the adjuster bolt is a T-bolt slidably adjustable in the T-slot. The connector may include a first diameter portion sized to fit into an opening in the door and a second diameter portion sized larger than the opening in the door. In this context, the connector may further include an O-ring fit over the first diameter portion abutting the second diameter portion. The connector may include a cylindrical member, where the offset aperture is spaced from an axial center of the connector.

In another exemplary embodiment of the invention, a door assembly includes a track; a door frame supporting a door panel; a truck member secured to the door frame and including moving structure engageable with the track, where the truck member supports an adjuster bolt; a connector including an offset aperture that fits over the adjuster bolt; and a nut engageable with the adjuster bolt to secure the connector to the truck member. A position of the door in the track is adjusted by rotation of the connector. In one arrangement, the door frame and door panel are part of a companionway door. The door panel is preferably formed of glass, and the door frame and door panel may be bent such that opposite ends are disposed in different planes.

In yet another exemplary embodiment of the invention, a door adjusting mechanism for adjusting a position of a door moving in a track includes a truck member secured to the door and including moving structure engageable with the track; and a connector connecting the truck member to the door, where the connector includes cam structure for adjusting a position of the door relative to the truck member, thereby adjusting a position of the door relative to the track. The cam structure may include an offset aperture that is fit over a bolt coupled with the truck member and secured with a nut.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
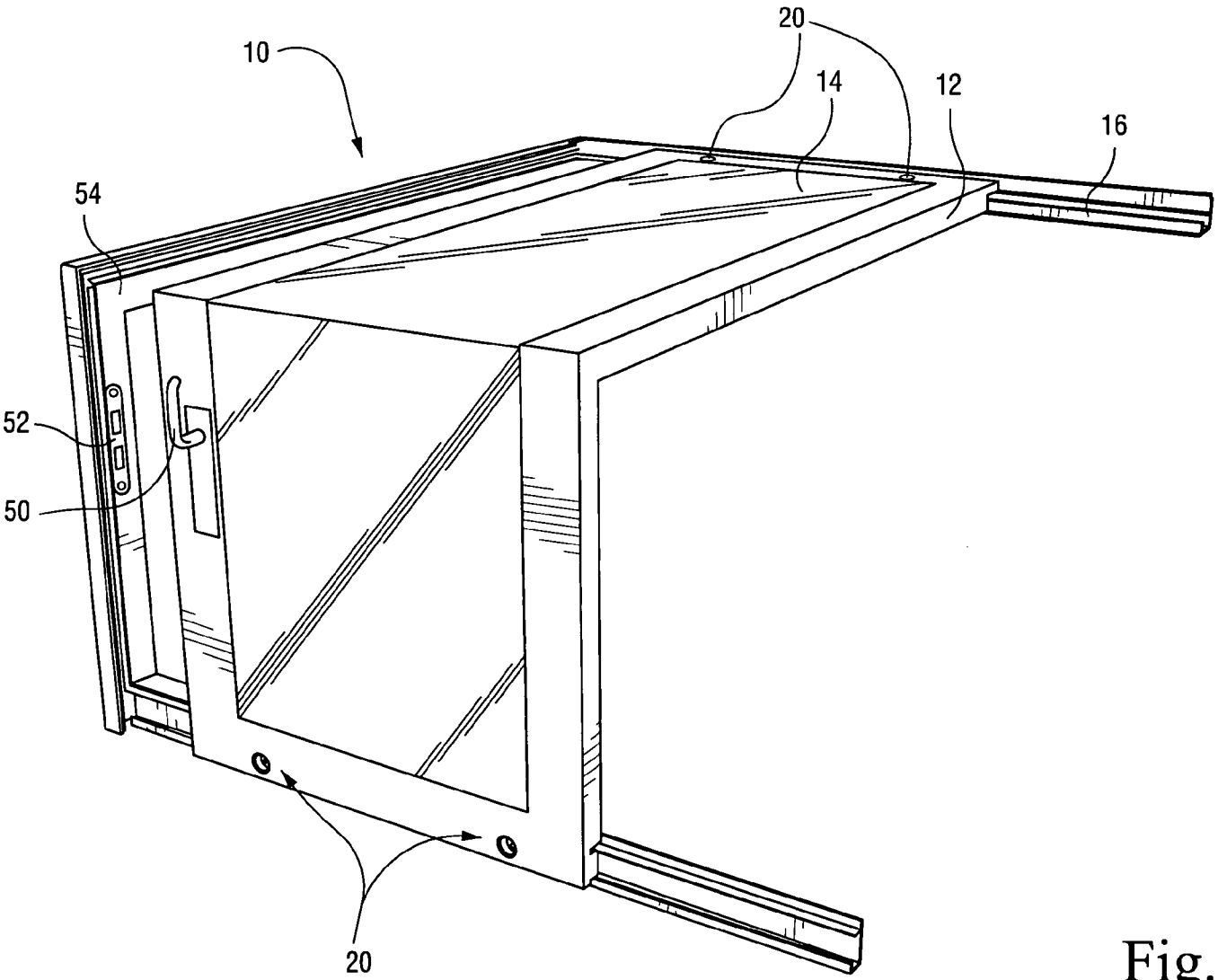
FIG. 1 is a perspective view of a companionway door incorporating the adjusting mechanism of the present invention.

FIG. 1 is a perspective view of an exemplary companionway door for which the adjusting mechanism of the present invention is particularly suited. A companionway door in a marine environment may be shaped such that opposite ends of the door panel are disposed in different planes, e.g., substantially perpendicular planes in the companionway door assembly 10 shown in FIG. 1. Due to the orientation and multiplanar configuration of such doorways, it is difficult to adjust the alignment of the door in its track and/or to accommodate size irregularities and manufacturing tolerances for smooth operation. Additionally, if the door becomes too far misaligned, not only will the door be more difficult to operate, but the door may not seat properly thereby permitting moisture to get in while preventing the door latch from catching.

The door assembly 10 includes a door frame 12 supporting a door panel 14. The door frame and panel 12, 14 are mounted for movement (e.g., sliding, rolling or the like) between open and closed positions in a track 16. The adjusting mechanism 20 of the invention secures the door 12, 14 in the track 16 and facilitates alignment adjustment of the door without requiring the door to be disassembled and/or removed from the track 16.

Figure 2:
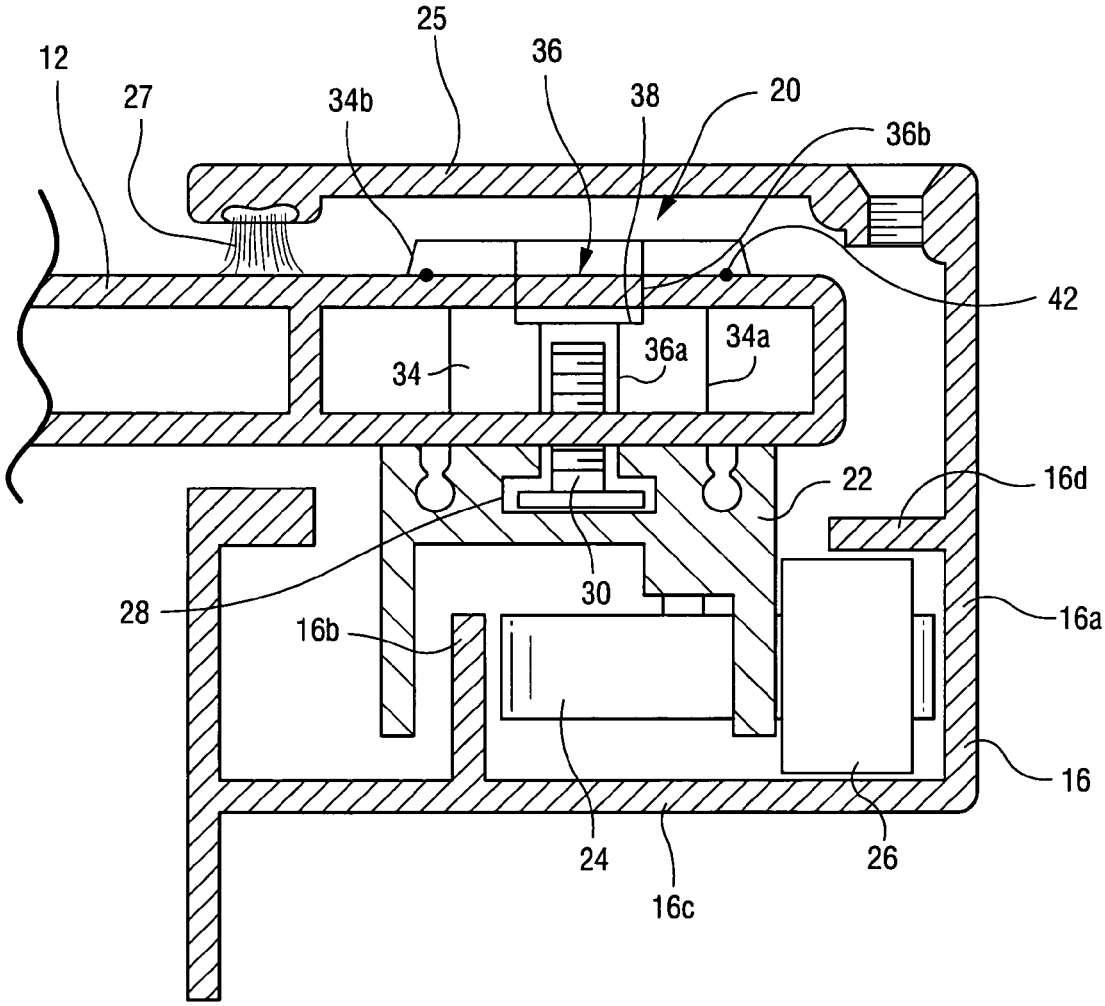
FIG. 2 is a cross-sectional view illustrating the components of door assembly and adjusting mechanism of the invention.

FIG. 2 is a cross-sectional view showing the door 12 engaged with the track 16 and including the adjusting mechanism 20 of the invention. A truck member 22 supports moving structure engageable with the track 16. In an exemplary embodiment, the truck member 22 supports a main roller 24 in a track defined by a sidewall 16*a* of the track and a first tab portion 16*b*. The truck member 22 preferably also supports a side roller 26 disposed in a track defined between the bottom wall 16*c* of the track 16 and a second tab member 16*d* as shown. The main roller 24 and the side roller 26 are thus oriented for traversing the track 16 on perpendicular surfaces. As a consequence, smooth movement of the door 12 can be obtained.

A track cover 25 is fixed to at least the top portion of the track 16 to divert water and to conceal the adjusting mechanism 20. Also preferably a conventional seal of any type (such as the seal 27 illustrated in FIG. 2) is associated with the track cover 25 to seal a space between the track cover 25 and the door 12.

The truck member 22 includes a T-slot 28 that is shaped to receive a T-bolt 30. The slot 28 extends generally along a width of the door 12 so that the T-bolt 30 is slidably positionable anywhere along the slot 28. The T-bolt 30 preferably has exterior threads as shown.

Figure 3:
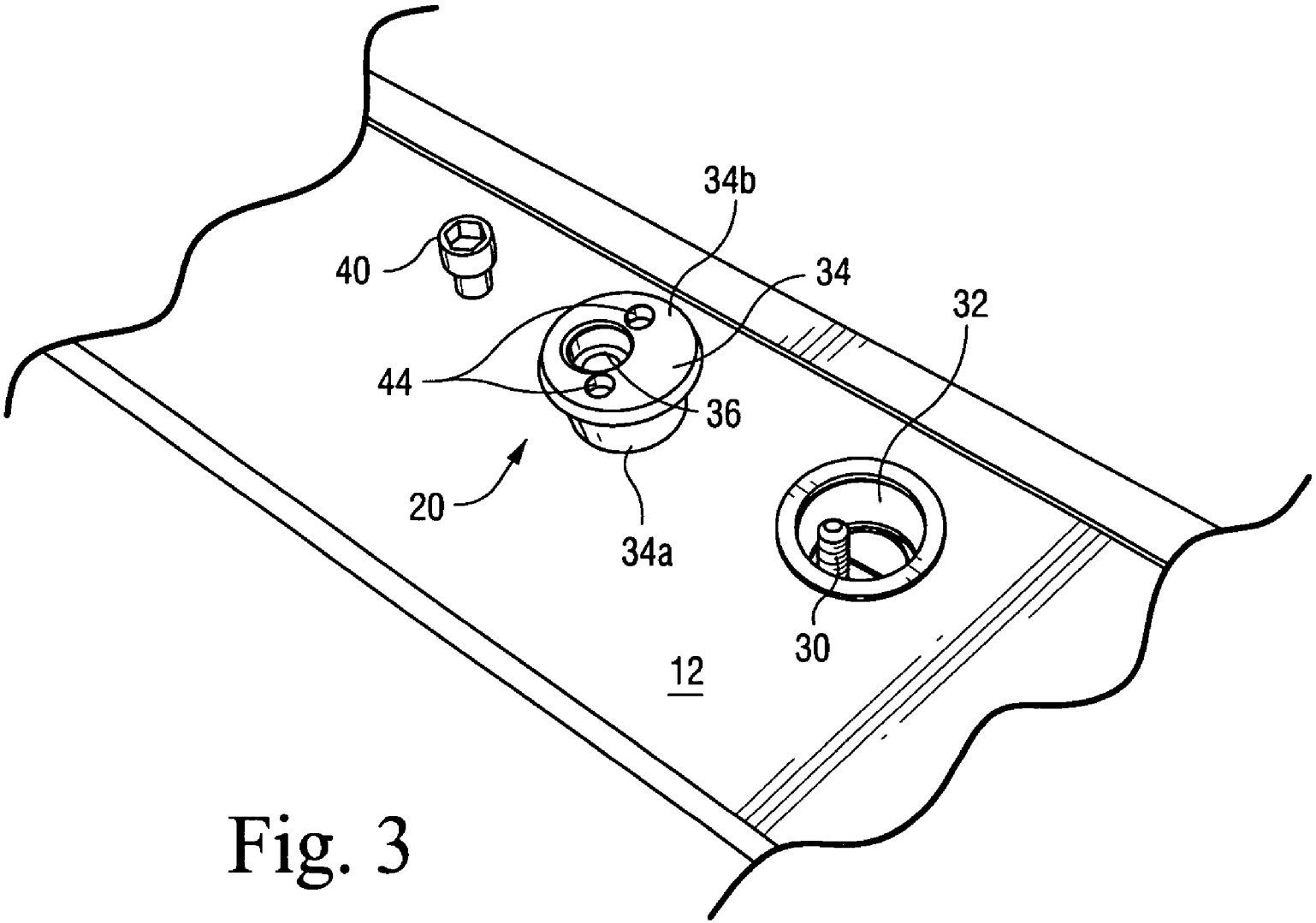
FIG. 3 shows a disassembled view of the adjusting mechanism.

With continued reference to FIG. 2 and with reference to FIG. 3, the door 12 is provided with at least one opening 32, and preferably several openings 32, along track engaging ends of the door. The openings 32 are substantially larger than a diameter of the T-bolts 30. The opening 32 size generally defines an adjustment range for the door assembly. The T-bolts 30 are positioned in the T-slot 28 to align with the opening(s) 32 in the door.

The adjusting mechanism 20 includes a connector 34 having a generally cylindrical first diameter portion 34*a* that is sized to fit in the opening(s) 32 and a second diameter portion 34*b* sized larger than the opening 32 such that the connector 34 is insertable into the opening(s) 32 until the second diameter portion 34*b* abuts against the door 12. The connector 34 includes an offset aperture as shown spaced from an axial center of the connector 34. The offset aperture 36 includes a first diameter section 36*a* sized to fit over the T-bolt 30 and a slightly larger second diameter section 36*b* defining a shoulder 38 at the transition where the first diameter section 36*a* and the second diameter section 36*b* meet. A nut 40 is engageable with the T-bolt 30 in the offset aperture 36. The nut 40 is preferably provided with internal threads to threadedly engage the T-bolt threads and a wider diameter head that engages the shoulder 38 when the nut 40 is attached to the T-bolt 30. In this manner, the nut 40 secures the connector 34 to the truck member 22. The first diameter section 36*a* is also preferably sized to fit over the nut 40. An O-ring 42 may be fit over the first diameter portion 34*a* of the connector 34 and disposed between the second diameter portion 34*b* and the door 12. By virtue of the O-ring 42, the adjuster nut 40 need not be significantly tightened until all adjustments are completed. In the illustrated exemplary embodiment, the adjuster nut 40 accommodates an Allen wrench, although any tool receptacle could be provided.

Figure 4:
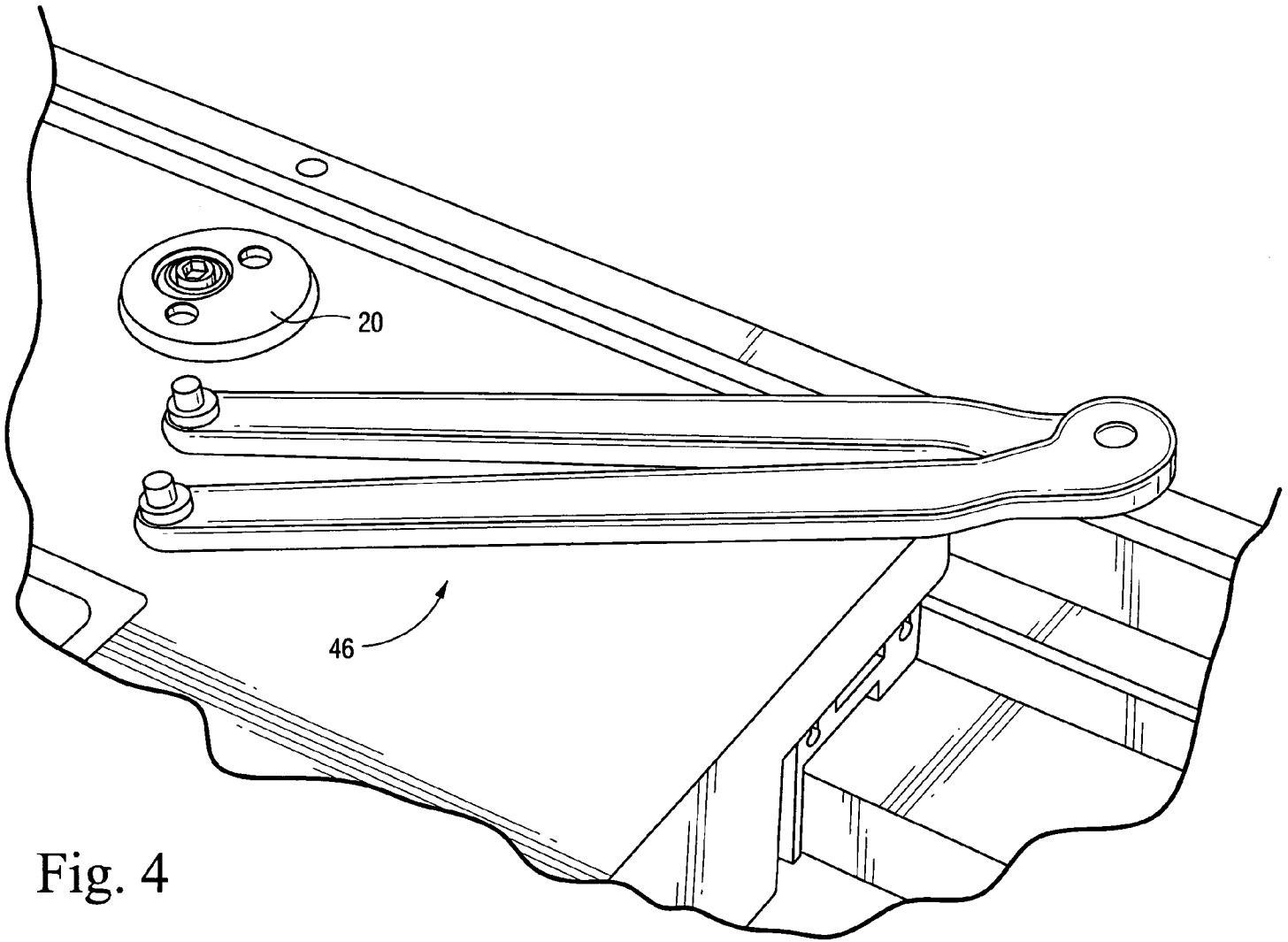
FIG. 4 illustrates the adjusting mechanism in an assembled state along with a spanner tool, which may be used for adjusting the connector of the mechanism.
Figure 5:
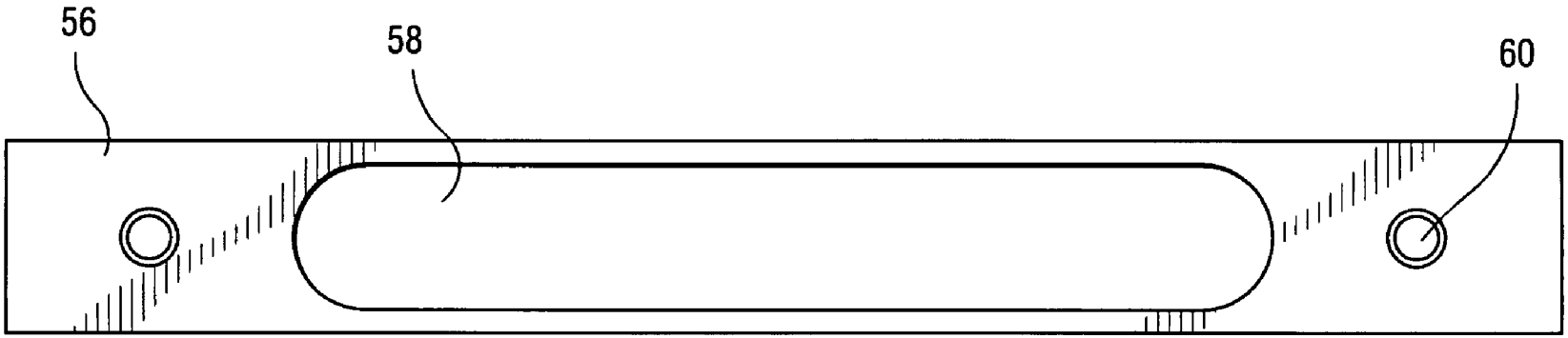
FIGS. 5-7 show a door jam and strike plate for the exemplary companionway door.
Figure 6:
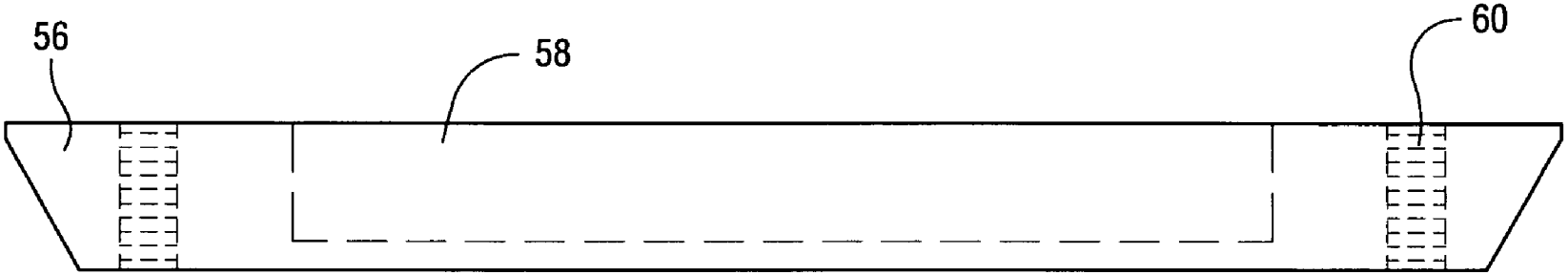

FIG. 4 shows the adjusting mechanism 20 in an assembled state. In an exemplary embodiment, the connector 34 is provided with adjustment apertures 44 that are sized to receive a conventional spanner 46. In use, in order to adjust the alignment of the truck member 22 relative to the door 12, the connector 34 is rotated by the spanner 46 or other suitable tool. In this manner, the offset aperture 36 acts as a cam member and shifts the relative position of the door 12 and truck member 22 via the T-bolt 30 to thereby effect adjustment for door alignment and to accommodate size irregularities and manufacturing tolerances. That is, for example, with reference to FIG. 4, if the connector 34 is rotated clockwise, the offset aperture and nut would be shifted from a position generally at 9 o'clock toward a position at 12 o'clock, thereby deflecting the door 12 relative to the truck member 22. Although the nut 40 may be loosened to facilitate rotation of the connector 34, adjustment can be carried out without disassembling the door assembly.

Figure 7:
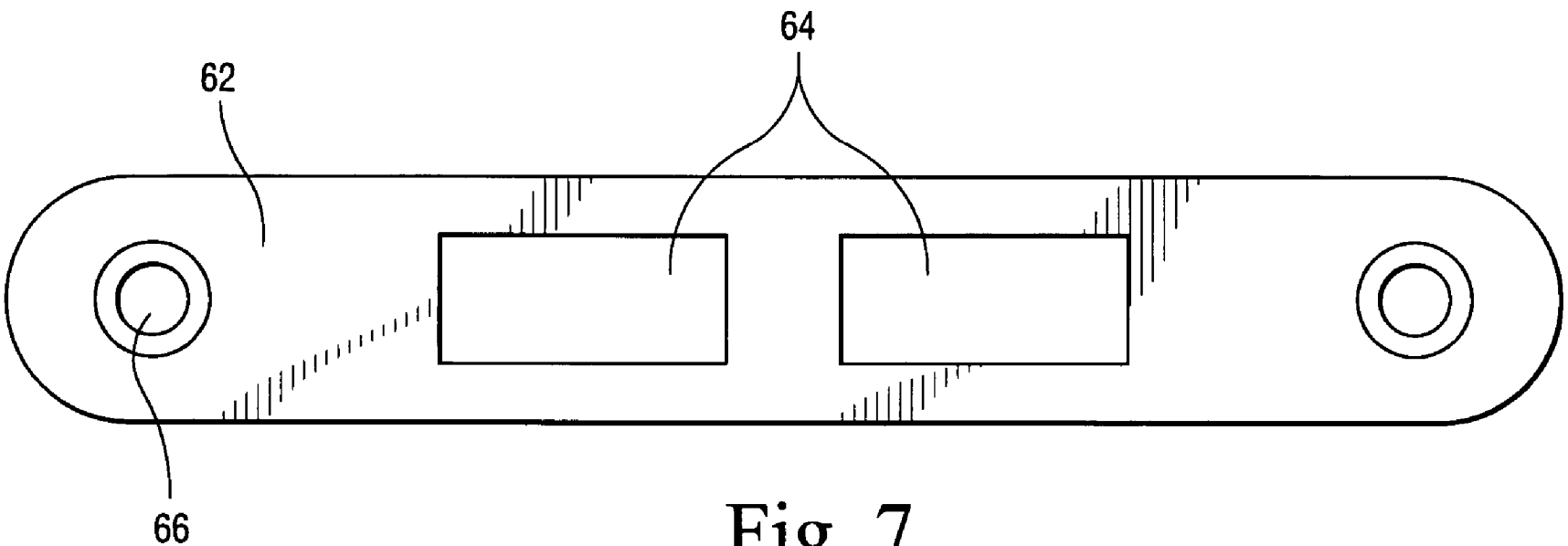

Once the door 12 is properly aligned in the track 16, the door 12 can be smoothly moved in the track 16 and latched closed via a handle assembly 50 and a striker assembly 52 (see FIG. 1). With reference to FIGS. 1 and 5-7, the striker assembly 52 is integrated with the door casing 54 to prevent water from reaching the door locking structure. The striker assembly 52 is formed of a solid material section 56 with a hollowed out "canoe" shaped section 58, which is formed via machining or the like. Engagement apertures 60 are formed at each end of the material section 56 for receiving suitable connectors to secure the material section 56 in the door casing 54. The door casing includes slotted apertures for receiving the connectors and enabling adjustment to accommodate manufacturing tolerances. As shown in FIG. 7, the striker plate 62 includes lock openings 64 for receiving the locking structure of the handle assembly 50 and apertures 66 opposed to the engagement apertures 60 of the material section 56 for receiving the connectors. In a preferred arrangement, a gasket (such as a rubber or vinyl sheet or the like) is interposed between the striker plate 62 and the material section 56. During assembly, a sheet of gasket material is fit over the material section 56, and openings are cut out over the canoe section 58. With the structure of the striker assembly 52, any water in the door casing 54 will be prevented from reaching the lock openings 64.

With the structure of the present invention, adjusting door alignment can be facilitated without requiring disassembly of the door components. The adjusting mechanism includes a connector that is configured such that rotation of the connector shifts a position of the door relative to truck member. As a consequence, a position of the door can be adjusted relative to the track. Additionally, the adjustments can accommodate size irregularities and manufacturing tolerances. As noted, the adjusting mechanism of the invention is particularly suited for a door assembly wherein opposite ends of the door are disposed in different planes, such as, for example, a substantially perpendicular companionway door. Such doors are typically cumbersome to adjust alignment and accommodate size irregularities and manufacturing tolerances, and the present invention enables easy adjustment with a simple adjusting mechanism.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A door adjusting mechanism for adjusting a position of a door moving in a track, the door adjusting mechanism comprising:

a truck member including moving structure engageable with the track, the truck member supporting an adjuster bolt;

a connector including an aperture offset with respect to a rotational centerline of said connector, said aperture fitting over the adjuster bolt with the door interposed between the connector and the adjuster bolt; and a nut engageable with the adjuster bolt to secure the connector to the truck member, the connector thereby securing the truck member to the door, wherein a position of the truck member relative to the door is adjusted by rotation of the connector.

2. A door adjusting mechanism according to claim 1, wherein the connector comprises adjustment apertures therein sized to receive a spanner for rotating the connector.

3. A door adjusting mechanism according to claim 1, wherein the truck member comprises a T-slot, and wherein the adjuster bolt is a T-bolt slidably adjustable in the T-slot.

4. A door adjusting mechanism according to claim 1, wherein the connector comprises a first diameter portion sized to fit into an opening in the door and a second diameter portion sized larger than the opening in the door.

5. A door adjusting mechanism according to claim 4, wherein the connector further comprises an O-ring fit over the first diameter portion abutting the second diameter portion.

6. A door adjusting mechanism according to claim 1, wherein the connector comprises a cylindrical member, and wherein the offset aperture is spaced from an axial center of the connector.

7. A door assembly comprising:

a track;

a door frame supporting a door panel;

a truck member including moving structure engageable with the track, the truck member supporting an adjuster bolt;

a connector including an aperture offset with respect to a rotational centerline of said connector, said aperture fitting over the adjuster bolt with the door frame interposed between the connector and the adjuster bolt; and a nut engageable with the adjuster bolt to secure the connector to the truck member, the connector thereby securing the truck member to the door frame, wherein a position of the truck member relative to the door frame is adjusted by rotation of the connector.

8. A door assembly according to claim 7, wherein the door frame and door panel comprise a companionway door.

9. A door assembly according to claim 7, wherein the door panel is glass.

10. A door assembly according to claim 9, wherein the door frame and door panel are bent such that opposite ends are disposed in different planes.

11. A door assembly according to claim 7, wherein the connector comprises adjustment apertures therein sized to receive a spanner for rotating the connector.

12. A door assembly according to claim 7, wherein the truck member comprises a T-slot, and wherein the adjuster bolt is a T-bolt slidably adjustable in the T-slot.

13. A door assembly according to claim 7, wherein the connector comprises a first diameter portion sized to fit into an opening in the door and a second diameter portion sized larger than the opening in the door.

14. A door assembly according to claim 13, wherein the connector further comprises an O-ring fit over the first diameter portion abutting the second diameter portion.

15. A door assembly according to claim 7, wherein the connector comprises a cylindrical member, and wherein the offset aperture is spaced from an axial center of the connector.

* * * * *